US005914458A

United States Patent [19]

Folsom et al.

[11] Patent Number: 5,914,458

[45] Date of Patent: Jun. 22, 1999

[54] DUAL FIBER LASER INITIATOR AND OPTICAL TELESCOPE

[75] Inventors: Mark F. Folsom, Carmel; Jerry D. Callaghan, Los Angeles, both of Calif.

[73] Assignee: Quantic Industries, Inc., San Carlos, Calif.

[21] Appl. No.: 08/979,392

[22] Filed: Nov. 26, 1997

Related U.S. Application Data

[63] Continuation of application No. 08/818,477, Mar. 14, 1997, abandoned.

[51] Int. Cl.[6] ..... F42C 19/00

[52] U.S. Cl. ..... 102/201

[58] Field of Search ..... 102/201, 200, 102/202; 73/167; 60/203.1

[56] References Cited

U.S. PATENT DOCUMENTS

| | | | |
|---|---|---|---|
| 4,700,629 | 10/1987 | Benson et al. | 102/201 |
| 4,870,903 | 10/1989 | Carel et al. | 102/201 |
| 4,917,014 | 4/1990 | Loughry et al. | 102/201 |
| 5,036,767 | 8/1991 | Folsom et al. | 102/201 |
| 5,191,167 | 3/1993 | Beyer | 102/201 |
| 5,204,490 | 4/1993 | Soltz et al. | 102/201 |
| 5,404,820 | 4/1995 | Hendrix | 102/201 |
| 5,406,889 | 4/1995 | Letendre et al. | 102/201 |
| 5,418,361 | 5/1995 | Pinnock et al. | 250/227.21 |

OTHER PUBLICATIONS

Presentation regarding Quantic Industries "V" initiator, dated Feb. 14, 1996.

*Primary Examiner*—Charles T. Jordan

*Assistant Examiner*—Theresa M. Wesson

*Attorney, Agent, or Firm*—Wilson Sonsini Goodrich & Rosati

[57] ABSTRACT

The present invention discloses an improved apparatus for performing safe and reliable built-in testing (BIT) of a laser initiated ordnance device. The system transmits light energy from a laser through optical fibers to achieve initiation of pyrotechnic or explosive charges and other ordnance. In the preferred embodiment, a separate BIT return fiber is included in the system in addition to the energy transmission fiber. The invention also incorporates a "telescope" comprising a pair of gradient-index (GRIN) rod lenses in series to first collimate and then reconcentrate light emitted by the energy transmitting fiber, while reflecting part of the light to an image at the face of the BIT fiber. Alternatively, an arrangement using a pair of aspheric silica lenses can be substituted for the GRIN lenses. The fraction of the light reflected to the BIT fiber can be controlled by specifying the reflectance at one of the lens end surfaces. The ratio of the output image size to the transmitting fiber core size (the magnification) can be controlled by appropriately selecting the focal lengths of the two lenses in the telescope. The invention also provides a simple means of making a spot size reduction (for example, from 100 microns down to 50 microns) without requiring alignment, and of adjusting the BIT amplitude response by adjusting the reflectance back from the second surface of the first lens. Because the combined pair of GRIN or other lenses has a magnification of less than unity, substantial power savings can also be achieved.

55 Claims, 8 Drawing Sheets

DUAL FIBER LASER INITIATOR AND OPTICAL TELESCOPE

This application is a continuation of U.S. application Ser. No. 08/818,477, filed Mar. 14, 1997 now abandoned.

BACKGROUND OF THE INVENTION

FIELD OF THE INVENTION

Laser initiation of explosives and pyrotechnics has held great potential promise for many years. Transmission of light energy from a laser through optical fibers allows reliable pyrotechnic initiation without the safety problems associated with hot bridgewire fired parts. Laser initiation has also held the promise of safe and reliable built-in testing (BIT) of the energy transmission system. It has also seemed possible to initiate laser fired cartridges with less energy than it takes to fire equally safe electrical initiators, and thus to reduce the size and weight of initiation systems.

In many ordnance initiation systems (such as space launch vehicles), the required functional reliability is such that it is necessary to check the integrity of as much of the system as possible immediately before launch. In other systems, such as emergency safety systems, intermittent system continuity checks are a prudent means of maintaining a high level of reliability. In typical present space launch vehicles, the continuity test function is performed manually by technicians on the launch pad while all other preparation activities are suspended. Built in test as envisioned in the present application verifies that each ordnance firing laser is connected to an optical initiator and that each optical initiator is connected to a BIT detector photodiode. This verification assures the user that lasers and initiators are connected and that none of the optical fibers are broken or otherwise disabled before the commencement of normal system operation. The capacity to perform continuity testing quickly, safely and automatically shortens the time between deciding to use a system and actually using it, eliminates the need to suspend other functions for an extended time and reduces the labor of preparation for system use.

Although some of the different advantages of laser initiators have been realized, they have generally not been realized together in a single embodiment. Systems that use the same optical fiber for energy transmission as for BIT suffer from ambiguity as a result of unwanted reflections of the transmitted light mixing with the desired BIT signal reflected from the initiator cartridge. Alternately, systems that use a separate BIT return fiber have improved signal to noise characteristics but suffer from increased size and complexity and are sensitive to a large number of alignment tolerances.

For example, U.S. Pat. No. 4,870,903 to Carel et al. discloses a laser driven initiator. However, Carel does not disclose any BIT mechanism to test the energy transmission system. Another laser driven ordnance apparatus, U.S. Pat. No. 5,404,820 to Hendrix, uses a complex scheme of diodes, splitters, and other apparatus to accomplish its BIT functions. Another system uses a "V" shaped path for the power from the laser, with the input power coming in one leg of the "V" and the BIT pulse going out of the other leg of the "V." This is a complex system to machine due to the tolerances involved.

SUMMARY OF THE INVENTION

The present invention solves the above deficiencies in the prior art by allowing the use of a separate BIT return fiber in a simple compact cartridge that is insensitive to most of the alignment tolerances in its construction and allows concentration of light on the explosive interface to greater intensity than it has on emergence from the energy transmission fiber. One embodiment of the invention incorporates a "telescope" comprising a pair of gradient-index (GRIN) rod lenses in series to first collimate and then reconcentrate light emitted by the energy transmitting fiber, while reflecting part of the light to an image at the face of the BIT fiber. The fraction of the light reflected to the BIT fiber can be controlled by specifying the reflectance at one of the lens end surfaces. The ratio of the output image size to the transmitting fiber core size (the magnification) can be controlled by appropriately selecting the focal lengths of the two lenses in the telescope. This embodiment of the invention also provides a simple means of making a spot size reduction (for example, from 100 microns down to 50 microns) without requiring alignment, and of adjusting the BIT amplitude response by adjusting the reflectance back from the second surface of the first lens. In an alternative embodiment, an arrangement using a pair of aspheric silica lenses can be substituted for the GRIN lenses. Such lenses are more resistant to radiation than are GRIN lenses and are desirable in high radiation environments such as space or nuclear applications.

The GRIN or aspheric silica lenses can also be used as an optical telescope independent of the BIT apparatus. In combination, the lenses help reduce the power requirements of the initiator. The first lens bends the light rays to form a collimated beam, while the second lens converges the beam and focuses the light ray on the explosive charge in the load cavity. Because of the focal lengths used, the combined magnification of the two lenses is less than one, that is, there is less than unity magnification. This results in a higher intensity beam at the explosive charge compared to the beam that would be achieved by unity or greater magnification, and reduces the amount of power needed in the incoming beam.

The invention thus allows separate fiber BIT using a side-by-side pair of optical fibers in a standard fiber-optic connector that interfaces with a simple compact cartridge. Alignment between the two lenses is not critical to the functioning of the cartridge either during firing or during test. Sub-unity magnification at the initiation interface permits initiation with minimal input energy but without compromising safety. Commercially available parts can be used to help minimize manufacturing cost.

BRIEF DESCRIPTION OF THE DRAWINGS

These and other features and advantages of the present invention will become more apparent to those skilled in the art from the following detailed description in conjunction with the appended drawings in which.

DETAILED DESCRIPTION OF THE PREFERRED EMBODIMENTS

Figure 1B:
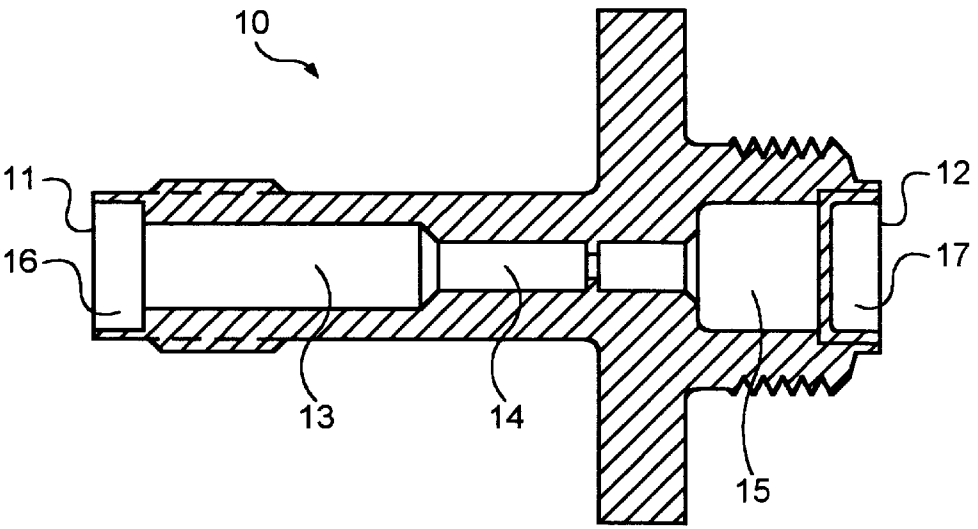
FIGS. 1A and 1B are diagrams of a cartridge used to house the optical path components of an embodiment of the invention.
Figure 1A:
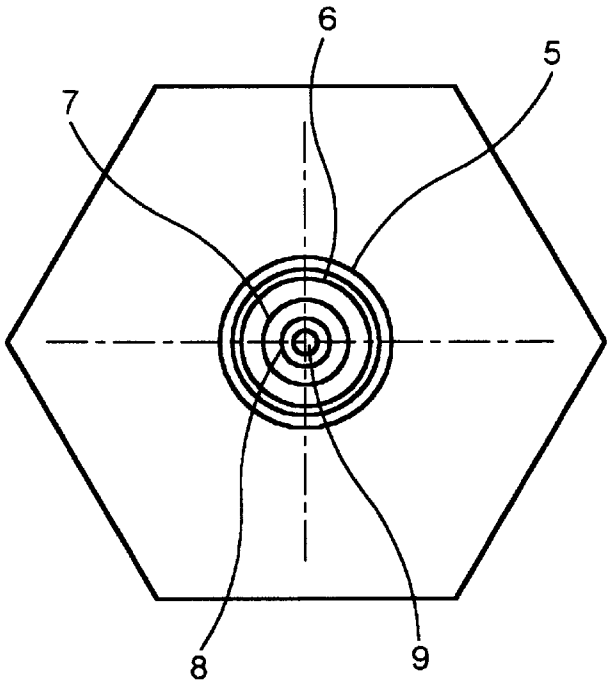

FIGS. 1A and 1B illustrate two perspective views of an embodiment of a cartridge used to house the laser initiator. In side view FIG. 1B, the cartridge 10 has an input end 11 and a closure end 12. Contained within the cartridge are fiber optic adaptor 13, lens seat 14, and load cavity 15. Fiber optic adaptor 13 accommodates a connector having a set of dual fibers (shown in FIG. 3 and discussed below). The lens seat 14 provides a means for mounting lenses in the proper relation to each other and to the cartridge body itself The input end 11 contains a receptacle 16 suitable for mating with a fiber-optic connector (not pictured). The load cavity 15 is located at the closure end 12, and is suitable for holding an explosive or pyrotechnic mixture or a plurality of such mixtures. Also located at the closure end 12 is an output closure 17 to contain and protect the explosive or pyrotechnic mixtures within load cavity 15.

FIG. 1A is an end view of FIG. 1B taken from the input end 11. The cartridge has a flange that is hex shaped to adapt easily to a standard wrench. Going from the outer end of the device to the center, there is a threaded outer diameter 5, an O-ring seal bore 6, a connector centering bore 7, an input lens centering bore 8, and a through hole 9. The dimensions of diameter 5, bores 6, 7 and 8, and hole 9 are dependent on the connector and lenses used.

Figure 2:
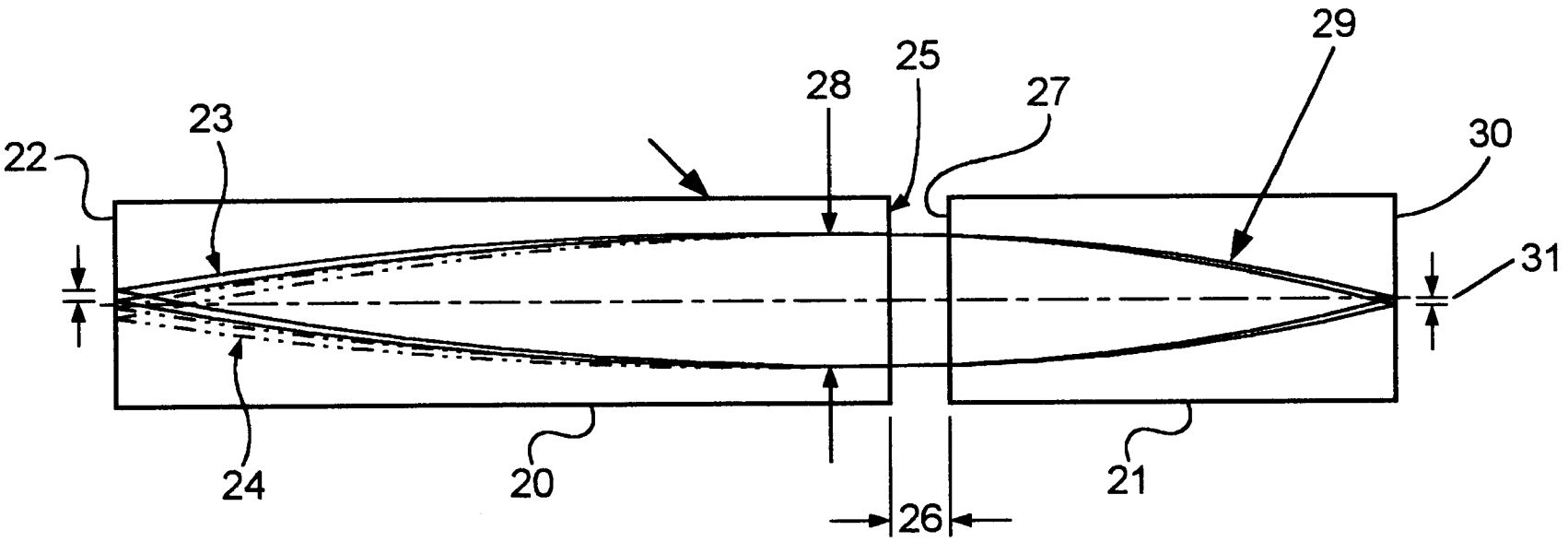
FIG. 2 is a diagram of the lens arrangement and optical train of an embodiment of the invention.

One embodiment of the invention includes a pair of gradient index, or GRIN, lenses 20 and 21, shown in FIG. 2. In the disclosed embodiment, each GRIN lens has an 0.25 pitch. An 0.25 pitch lens maps ray directions at the input end to locations at the output end and maps impingement locations at the input end to ray directions at the output end. GRIN lens 20 may preferably be an 06 LGS 212, and lens 21 may preferably be an 06 LGS 216, each available from Melles Griot, Inc., 1770 Kettering Street, Irvine, Calif. 92714. Specifications for these lenses in this embodiment are preferably as follows:

| Part No. | Diameter | Length | Focal Length | On Axis Refractive Index |
|---|---|---|---|---|
| 06 LGS 212 | 2.0 mm | 6.5 mm | 2.64 mm | 1.557 |
| 06 LGS 216 | 1.8 mm | 3.7 mm | 1.44 mm | 1.646 |

Alternatively, embodiments of the invention may use lenses obtained from NSG America, Inc., 28 Worlds Fair Drive, Somerset, N.J. 08873. Specifications of the lenses from this manufacturer are preferably as follows.

| Part No. | Diameter | Length | Focal Length | On Axis Refractive Index |
|---|---|---|---|---|
| SLH 200 025 083 | 2.0 mm | 6.46 mm | 2.64 mm | 1.5569 |
| SLH 180 025 083 | 1.8 mm | 3.71 mm | 1.44 mm | 1.6457 |

The optical system functions by exploiting the focusing properties of the 0.25 pitch lenses 20 and 21. The first or input lens 20 bends the divergent rays emerging from a compact source at its input end 22 to produce nearly parallel, but larger, beams 23 and 24 at its output end 25. Beam 23 is an input ray beam, and beam 24 is the BIT ray beam. A portion of the light reaching the output end 25 of the first lens 20 is specularly reflected back toward the input end 22 of the lens, by using a partly reflective dielectric coating on the output end 25. (Alternatively, the dielectric coating can be on the input end 27 of the second lens 21.) Multilayer dielectric stack coatings are a well known art and are available commercially from a wide range of vendors, but the details of the composition and structure of each specific coating are treated as proprietary by those vendors. The rays 23 and 24 of this portion are bent so as to form an image of the light source on the input end 22, but symmetrically opposite the lens axis from the source location. In other words, the image is simply an inverted image of the emitting object. Thus, by having the energy transmission fiber and the BIT fiber (discussed further below) symmetrically opposed about the lens axis, the input lens 20 can be used to reflect a test signal originating from the input fiber and focus it into the BIT fiber with high efficiency.

The light that is not reflected by the output end 25 of the first lens 20 crosses the gap 26 between the lenses and impinges on the input end 27 of the second lens 21. The divergence angle, in radians, of the light emerging from the first lens is approximately the diameter of the source (the input fiber) divided by the focal length of the lens. In one embodiment, the gap 26 is approximately 0.500 millimeters and the diameter 28 of the light emerging from the first lens is approximately 1.076 millimeters. The second lens 21 converges the output rays 29 to form an image of the source at the second lens' output surface 30. The diameter 31 of that image is approximately the divergence angle, in radians, of the light at the input end 27, times the focal length of the second lens. In one embodiment, that diameter 31 can be approximately 0.056 millimeters. Therefore, the magnification of the whole imaging system is the focal length of the second lens 21 divided by the focal length of the first lens 20. In the preferred embodiment, this magnification would be 1.44 mm divided by 2.64 mm, or approximately 0.55. This is the opposite of the magnification for an astronomical telescope or other telescopes that are viewed with the one's eye: in those devices, greater magnification appears as the result of greater divergence and the magnification is the focal length of the "objective" divided by the focal length of the "ocular."

Other embodiments of the focal lengths and magnifications would be satisfactory. For instance, other suitable magnifications could range from 0.25 to 4.00.

Figure 3:
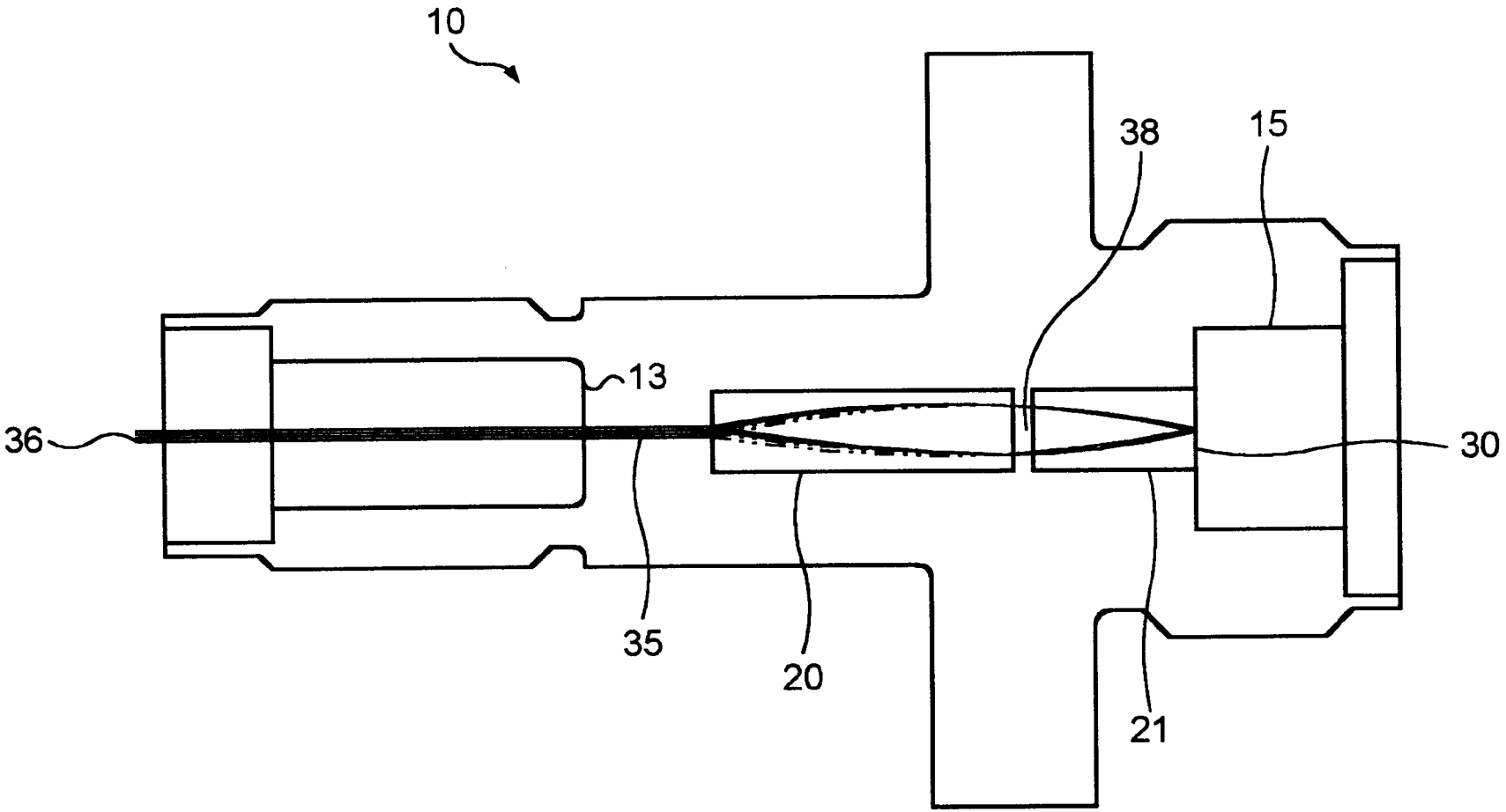
FIG. 3 is a detailed view of the cartridge of FIG. 1 and the lens arrangement of FIG. 2 showing part of the path of the laser beam, including the optics and rays located within a partial outline of the cartridge body.
Figure 4B:
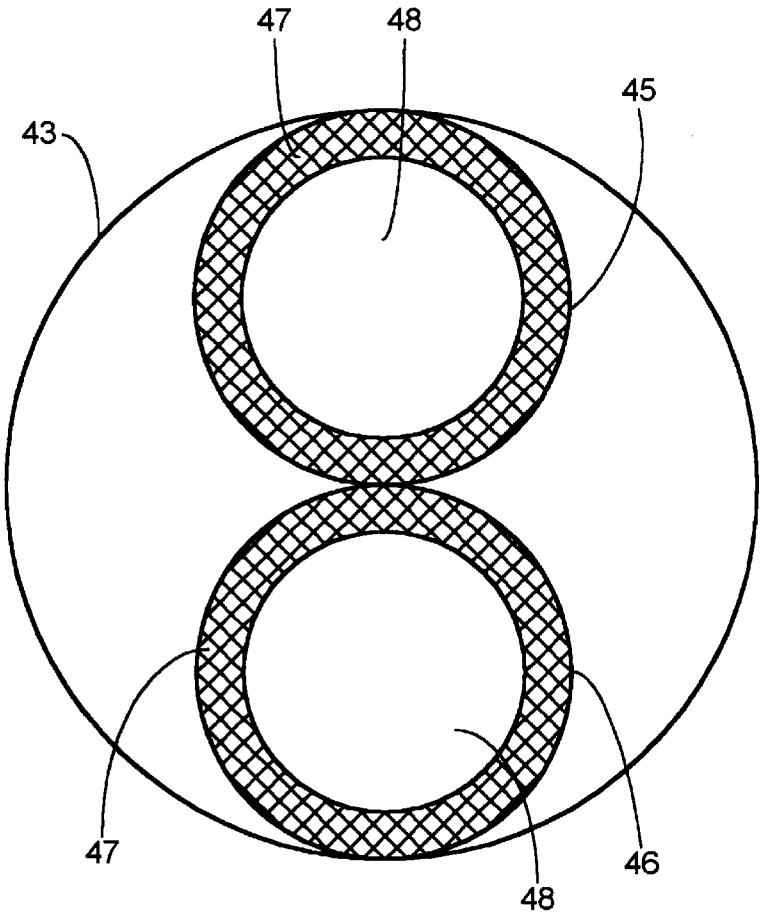
FIGS. 4A and 4B are detailed cross sectional views of the source end of FIGS. 2 and 3.
Figure 4A:
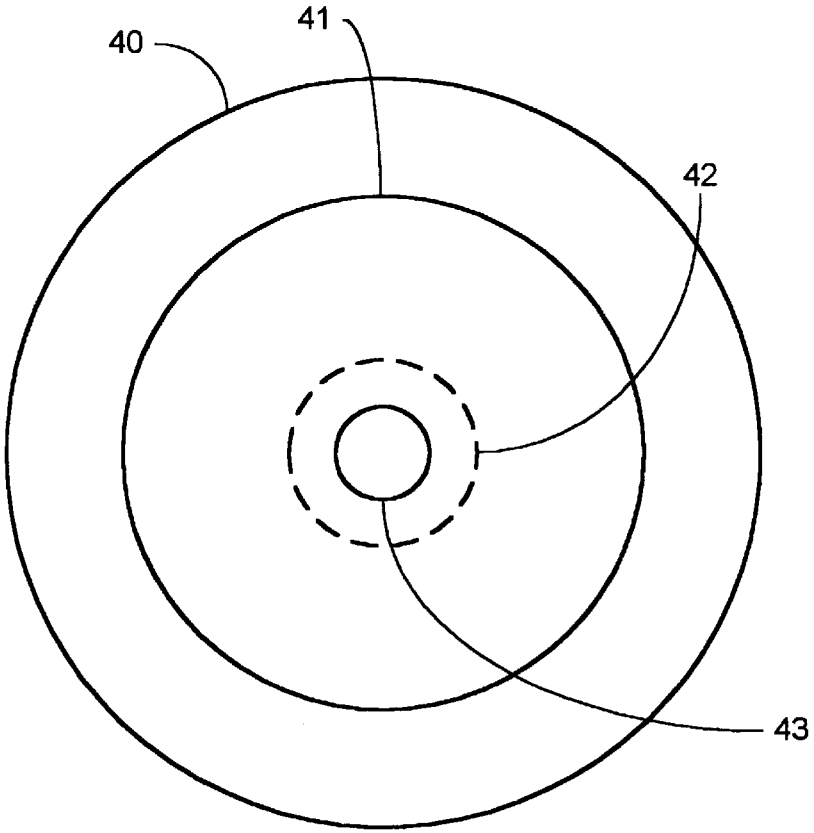

As shown in FIGS. 2 and 3, the input source to input lens 20 comprises a pair of fibers 35 which are symmetric about the axis of the input lens. One fiber is an energy transmission, or firing, fiber and the other is the BIT fiber. FIGS. 4A and 4B show a cross-sectional or side view of the source end of FIGS. 2 and 3, showing the side-by-side construction of the fibers. The cross section is adjacent to the input end of the input lens. FIG. 4B is a detailed view of the larger cross section of FIG. 4A. The outer circumference 40 is a fiber optic connector ferrule; 41 depicts an edge of the chamfer on the end of the connector, and 42 is a dashed line showing the boundary of the inset which is shown in FIG. 4B. At the middle of FIG. 4A is the centered common hole 43 which encloses the fibers.

FIG. 4B shows an enlargement of the centered common hole 43, at approximately ten times the scale of FIG. 4A. The firing fiber 45 and the BIT fiber 46 should be symmetrically opposed about the input lens axis. Both fibers include fiber cladding 47, which may typically be 0.14 millimeters in diameter, and fiber core 48, which typically may be 0.1 millimeters in diameter. The selection of which fiber is which is of no consequence to the cartridge. The typical preferred fibers are 100 micron core multimode step-index silica/silica fibers with a numerical aperture of 0.2 or more. One source of such fibers is Polymicro Technologies, Phoenix, Ariz.

The fraction of the light reflected to the BIT fiber can be controlled by specifying the reflectance at the output end of the input lens end surface. Alternatively, it can be controlled by specifying the reflectance at the input end of the output lens end surface. The ratio of the output image size to the transmitting fiber core size (the magnification) can be controlled by appropriately selecting the focal lengths of the two lenses in the telescope. Magnifications as low as ½ are possible with commercially available GRIN lenses, which could produce four times the light intensity at the initiation interface as at the transmitting fiber output.

As shown in FIGS. 2 and 3, the image that is formed by this optical system is projected on the output surface 30 of the second lens 21. The manufacture of the initiator installs the material to be ignited against or very near the output surface of the second lens, contained in load cavity 15, so that the material is able to absorb the ignition energy at the place where it is most intense. This minimizes the energy required to initiate a chemical reaction in the material.

The firing fiber 45 and the BIT fiber 46 are touching or very near to the input face, and their respective axes are approximately parallel to the cylindrical axis of the input lens. The firing fiber 45 is laterally displaced approximately one half of its diameter from the axis of the input lens, and the BIT fiber 46 is displaced by the same amount in a direction symmetrically opposite from the displacement of the firing fiber. Light is delivered to the input end 22 of input lens 20 via the core of firing fiber 45 and, since input lens 20 is a quarter-pitch lens, the light is refracted by the input lens 20 so that at its output end 25 the distribution of propagation directions of the input beam is transformed to locations on the output face 25 and the distribution of input locations on the input face 22 is transformed to propagation directions on the output face. Since the firing fiber is displaced from the center of the lens input face 22, there is a resulting overall bias in the propagation direction of light reaching the output face 25. A partially reflective coating 38 is applied to the output face 25 of the input lens 20; it reflects a fraction, preferably about 10%, of light impinging on it and allows as much as possible of the remainder to pass through unaffected. The light reflected from coating 38 propagates away from the output end 25 symmetrically opposite from the way it arrived, and the lens transformation is inverted so that an image of the firing fiber is formed on the input face of the input lens at a location symmetrically opposed across the lens axis from the end of the firing fiber. This image location is also the position of the end of the BIT fiber 46, and the light in that image is transmitted through the BIT fiber to the BIT receiver. The light that is not reflected at the output surface 25 of the input lens passes into the output lens 21 and the lens transformation is reversed to form an inverted image of the firing fiber core end. The approximate diameter of the image formed is the diameter of the input fiber core times the focal length of the output lens divided by the focal length of the input lens. (As noted above, alternatively the dielectric coating can be on the input end 27 of the second lens 21.)

When the system is operated in BIT mode, the power transmitted through the firing fiber 45 is very much smaller than that required to ignite the charge at the output surface of the output lens, but is great enough to be detected by a photodiode at the BIT receiver (or other photon sensitive detector). The presence of light at the BIT detector when a small signal is applied to the firing fiber, along with its absence when light is not applied to the firing fiber, indicates optical continuity from the firing laser through the firing fiber to the cartridge input lens and back through the BIT fiber.

Alternatively, coating 38 can be a wavelength selective coating that passes light of a wavelength used for firing the part and reflects light of a wavelength used for BIT. In this case, a higher BIT return ratio will be available even though the dispersion of the lens will cause the two wavelengths to focus somewhat differently.

Figure 5:
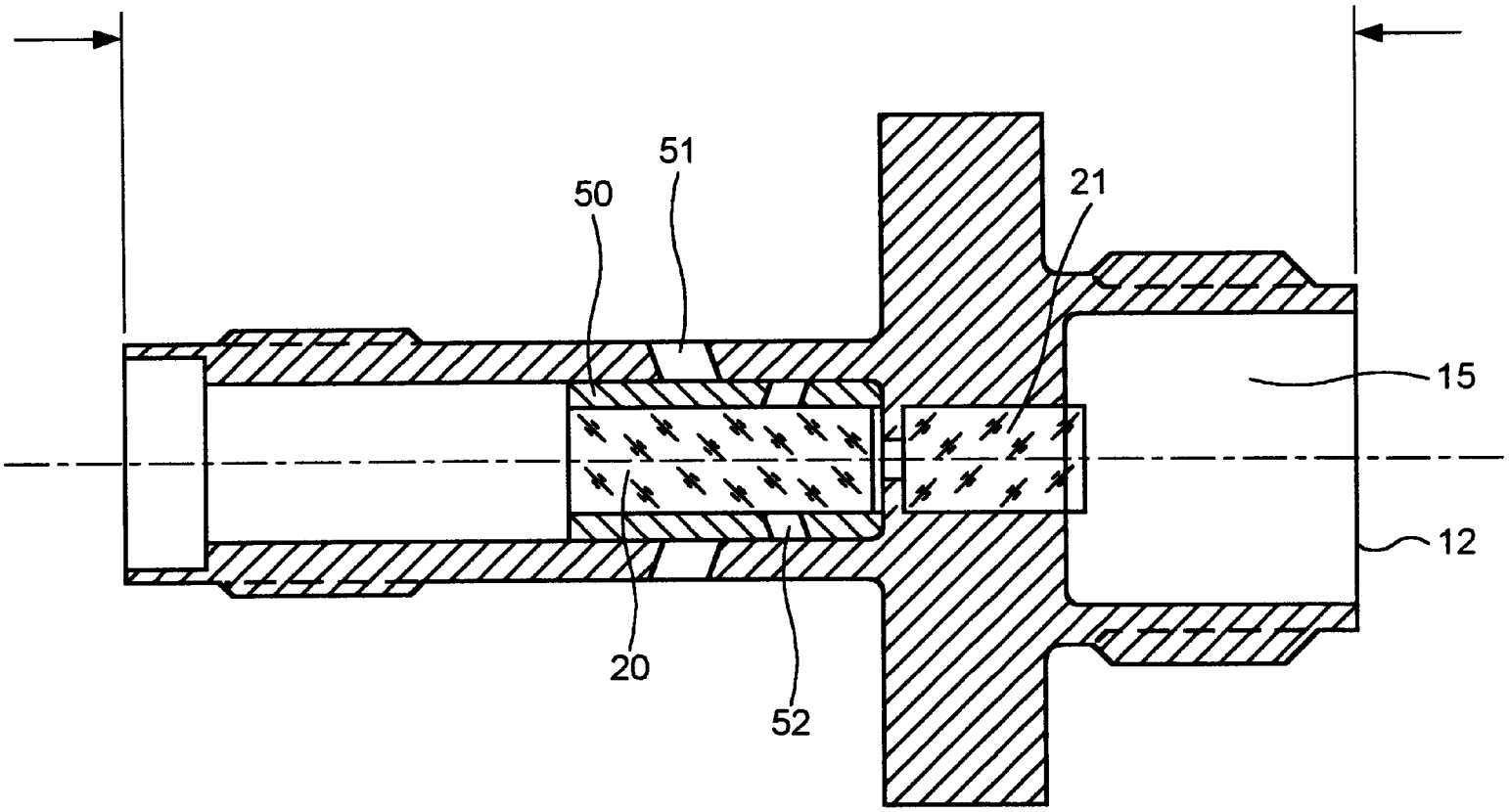
FIG. 5 illustrates steps in the manufacture of an embodiment of the invention.

FIG. 5 illustrates how the cartridge 10 is assembled. Output lens 21 is placed into the cartridge body from the output side of the cartridge (the side with the output closure 12 and the load cavity 15). The output lens is then soldered or epoxied into the cartridge body to form a hermetic or environmental seal. Note that there is a slight step in the cartridge body to provide retention of the output lens when the output charge fires. (When the output charge fires, it would be undesirable if the charge were to eject the lens out of the cartridge body.) Input lens 20 is glued into lens holder 50 by feeding glue through lens holder glue hole 52. The lens holder 50 is then glued into the cartridge body by feeding glue through cartridge glue hole 51. In the preferred embodiment, the glue used can be epoxy or cyanoacrylate. The cartridge body is typically made of a solid piece of austenitic stainless steel or Inconel 718 or titanium or some suitable polymeric resin. Cartridge bodies are generally custom made at any one of many thousands of suitable machine shops in the USA. An ignition charge (not shown) is placed in the load cavity 15 near the output end of the output lens 21. The output closure 12 is then placed over the load cavity.

Figure 6:
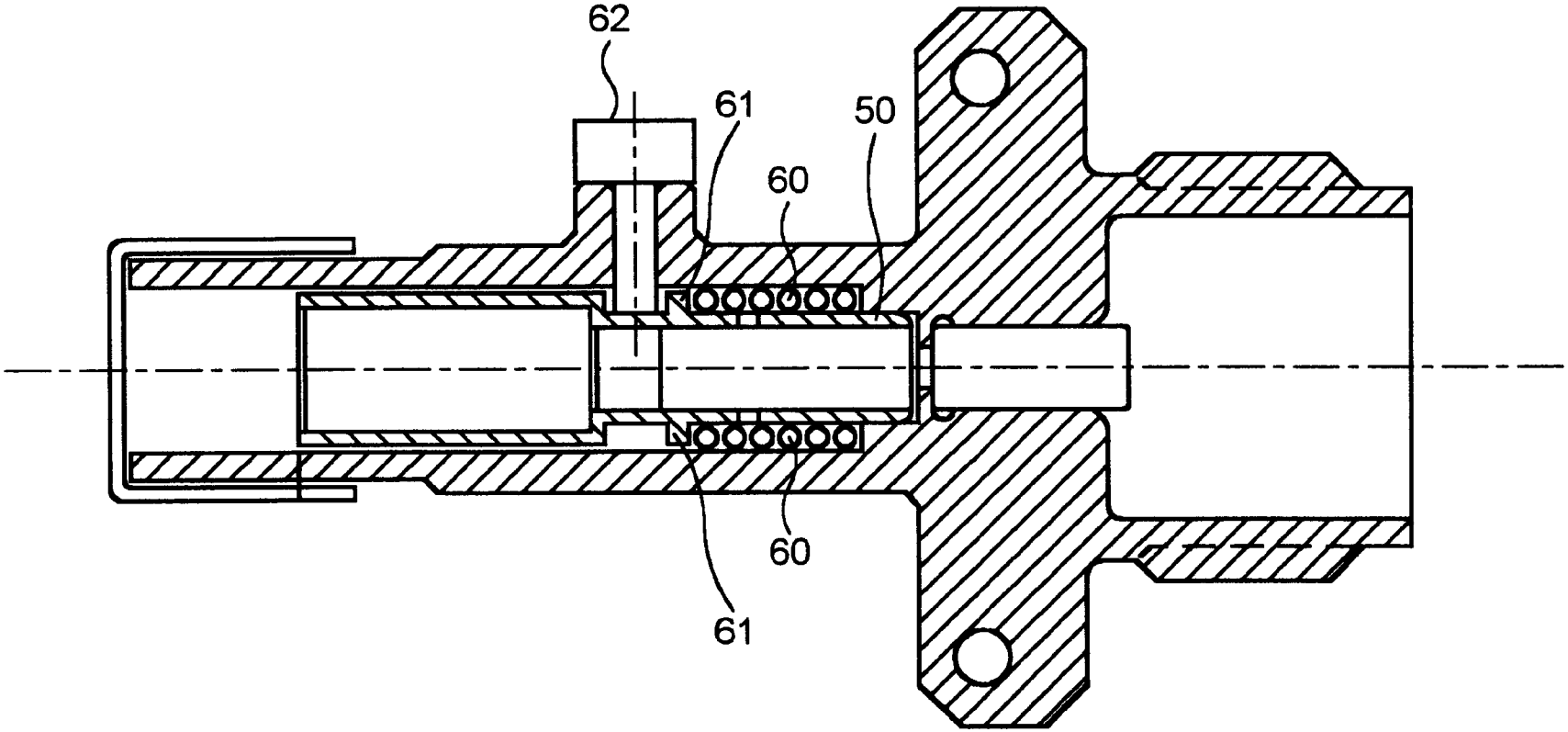
FIG. 6 is an alternative embodiment of the cartridge of FIGS. 1A and 1B.

FIG. 6 is an alternate embodiment of the invention. Instead of gluing the lens holder 50 into the cartridge body, the lens holder is held in place by a spring 60 which biases the lens holder against a fiber-optic connector (not shown). A flange 61 is mounted on the lens holder 50 to act as a stop for the spring and to act as a stop for the retaining pin 62. When a mating fiber-optic connector is inserted and tightened onto the cartridge, the connector presses on the lens and the lens holder 50, so the lens holder is displaced slightly toward the load end while spring 60 complies with the displacement and holds the lens to the connector. Another alternative is to fuse a piece of glass to the cartridge body between the lenses to form a hermetic seal and pressure withstanding seal. This glass does not effect the optical properties of the invention since the light rays in this area have been collimated by the input GRIN lens 20.

The pair of GRIN lenses 20 and 21 have other advantages besides just being part of the BIT apparatus. In combination, the lenses help reduce the power requirements of the initiator. The first lens 20 bends the light rays to form a collimated beam, while the second lens 21 converges the beam and focuses the light ray on the explosive charge in the load cavity. Because of the focal lengths used, the combined magnification of the two lenses is less than one, that is, there is less than unity magnification. In the preferred embodiment, this magnification is about 0.55. This results in a higher intensity beam at the explosive charge compared to the beam that would be achieved by unity or greater magnification. This reduces the amount of power needed in the incoming beam.

Figure 7:
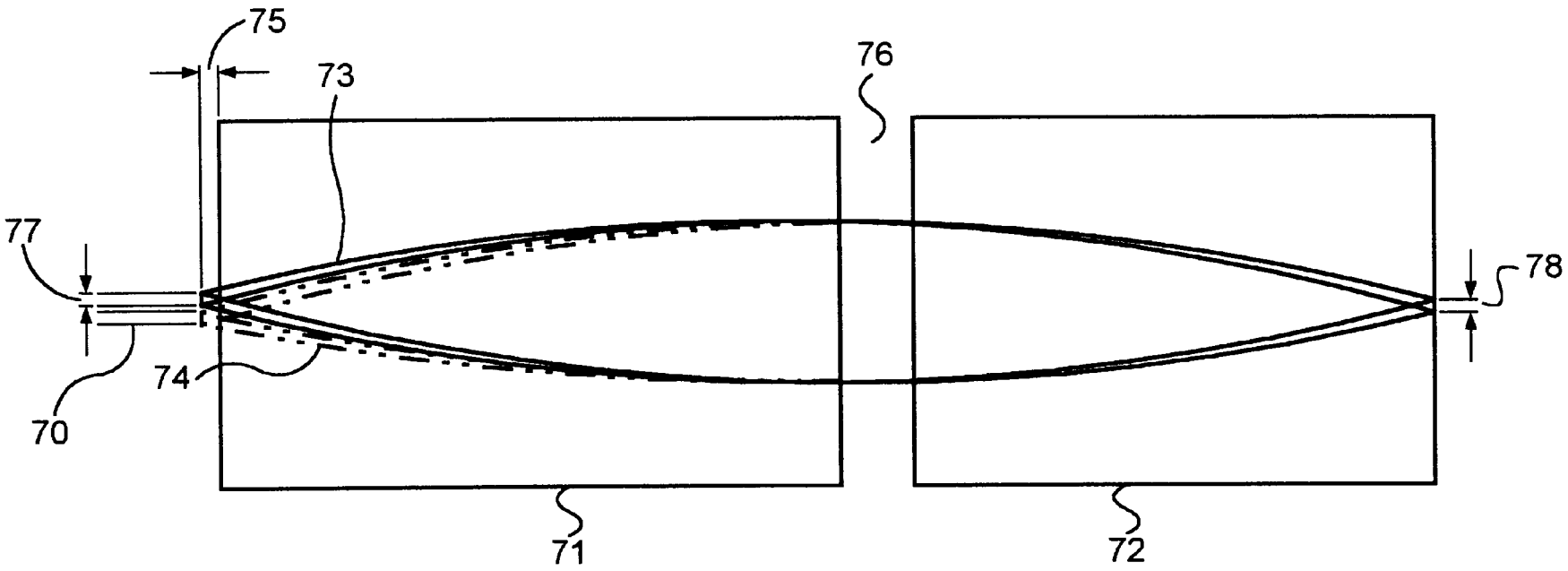
FIG. 7 is an alternative embodiment of the optical train of FIGS. 2 and 3, in which the fibers stand off from the lens.

FIG. 7 is a side view of an alternate embodiment of the invention which uses gradient index lenses 71 and 72, and which has a prescribed gap 75 between optical fibers 70 and the input end of the input lens 71. Two optical fibers 70 are positioned symmetrically opposite from each other about the axis of input lens 71. Input lens 71 is a gradient index lens having pitch less than 0.25, such as Melles Griot part number 06 LGT 214, which has 0.23 pitch. Output lens 72 is a gradient index lens having 0.25 pitch, such as Melles Griot part number 06 LGS 216, and is located near the output end of input lens 71, separated by variable gap 76. In use, the first of the optical fibers 70 emits radiation 73 which is collimated by input lens 71 and part of which can be reflected by the output surface of the input lens 71 or the input surface of the output lens 72. The reflected portion 74 of rays 73 is refocused by input lens 71 and forms a reduced intensity full-sized inverted image of the end of the first of the optical fibers 70 on the end of the second optical fiber. The radiation thus injected into the second of the fibers 70 can be used by a built-in-test system to detect that the fibers 70 are positioned properly with respect to input lens 71. The unreflected portion of rays 73 are focused by output lens 72 to form an inverted image on the output surface of the output lens 72. If the focal length of output lens 72 is less than the focal length of input lens 71, as is the case in with the example lenses mentioned, then image diameter 78 will be less than source diameter 77, that is, the system magnification will be less than unity.

Figure 8:
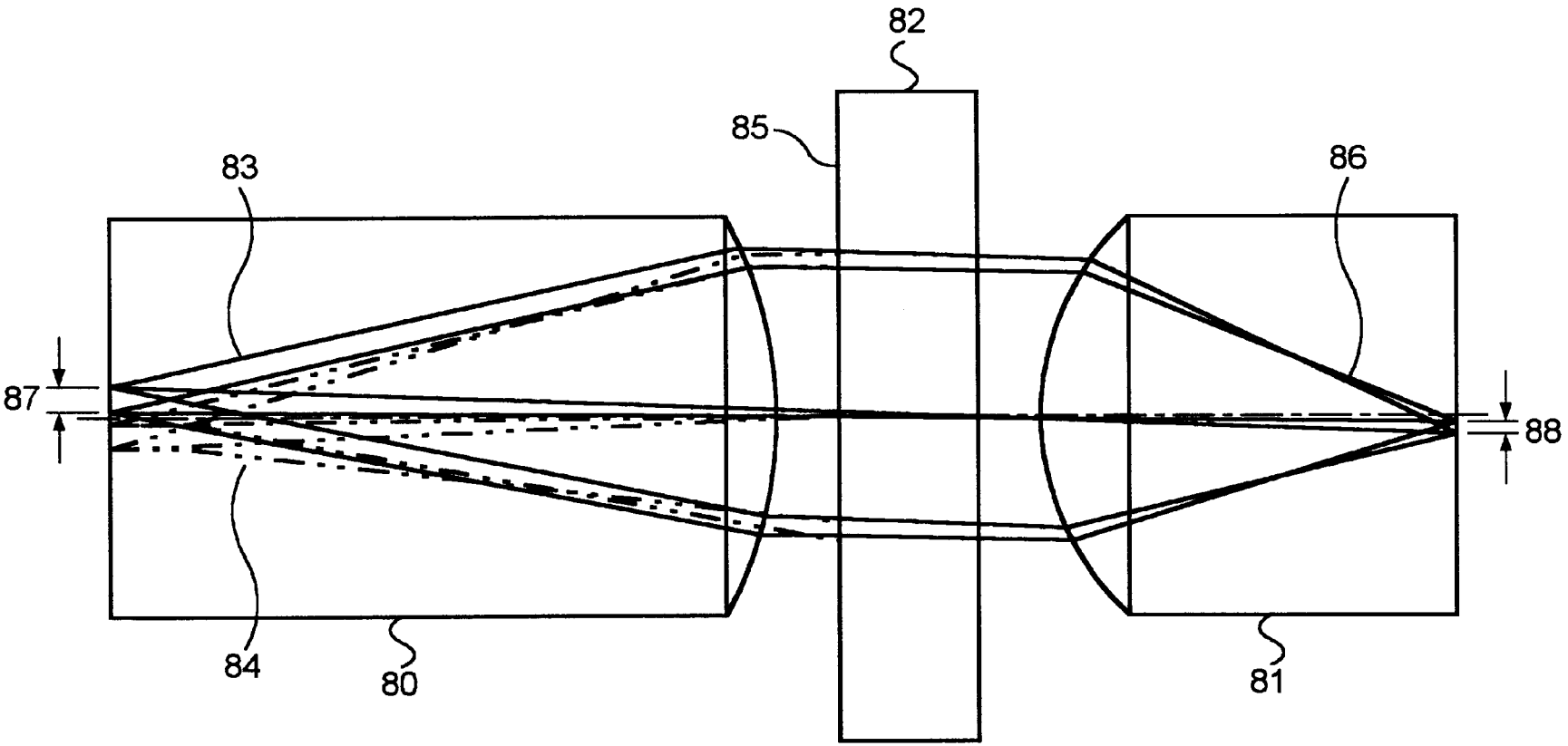
FIG. 8 is an alternative embodiment of the invention using a different lens arrangement.

FIG. 8 is an alternate embodiment of the invention in which an arrangement of aspheric silica lenses 80 and 81, and a silica window 82, are substituted for the GRIN lens arrangement. GRIN lenses are effective and convenient for use in optically initiated ordnance devices, but they have the disadvantage that they darken unacceptably when exposed to large doses of ionizing radiation. Thus, the use of GRIN lenses is acceptable and sometimes preferred in laser initiators in low radiation environments, but a substitute having similar optical properties but radiation darkening resistance is needed for high radiation environments such as space or nuclear applications. Radiation resistant glasses, such as fused silica and some cerium oxide doped glasses show vastly greater resistance to radiation darkening than do GRIN lenses, but are typically used only in conventional constant-index optics.

The embodiment of FIG. 8 allows the use of curved-surface constant-index radiation-darkening resistant optics in laser initiated ordnance, while retaining insensitivity to alignment tolerances in cartridge construction and the concentration of light on the explosive interface to greater intensity than it has on emergence from the energy transmission fiber. It does these things by using lenses made to tight length and curvature tolerances to collimate and then reconcentrate light emitted by the energy transmitting fiber, and using a separate flat window to reflect part of the light to an image at the face of the BIT fiber. The fraction of the light reflected to the BIT fiber can be controlled by specifying the reflectance at one of the window end surfaces. The ratio of the output image size to the transmitting fiber core size (the magnification) can be controlled by appropriately selecting the focal lengths of the two lenses in the telescope. Magnifications as low as ½ are possible with feasible aspheric lenses, which could produce four times the light intensity at the initiation interface as at the transmitting fiber output.

In FIG. 8, aspheric silica lenses 80 and 81 may or may not have a prescribed gap between optical fibers (not shown) and the input end of the input lens 80. Optical fibers (not shown) are positioned symmetrically opposite from each other about the axis of input lens 80. Input lens 80 is an aspheric silica lens. Window 82 is a flat silica window positioned with its flat surfaces perpendicular to the axis of input lens 80; the window has a partially reflective coating 85 on either the input surface (as shown) or the output surface (not shown). Output lens 81 is an aspheric silica lens having its input end positioned near the output end of window 82, separated by a variable gap. In use, the first of the optical fibers emits radiation 83 which is collimated by input lens 80 and part of which can be reflected by the partially reflective surface 85 of window 82. The reflected portion 84 of rays 83 is refocused by input lens 80 and forms a reduced intensity full-sized inverted image of the end of the first of the optical fibers on the end of the second optical fiber. The radiation thus injected into the second of the fibers can be used by a built-in-test system to detect that the fibers are positioned properly with respect to input lens 80. The unreflected portion of rays 83 are focused by output lens 81 to form an inverted image on the output surface of the output lens 81. If the focal length of output lens 81 is less than the focal length of input lens 80, as is the case in with the lenses depicted, then image diameter 88 will be less than source diameter 87, that is: the system magnification will be less than unity.

In a preferred embodiment, details of the lens arrangement of FIG. 8 are as follows. The aspheric silica lenses of FIG. 8 are available from Geltech, Orlando, Fla. They are both made from pure synthetic fused silica. The diameters of lenses 80 and 81 can both be 2.0 millimeters. Input lens 80 can have a length of 2.5 millimeters, while output lens 81 can have a length of 3.0 millimeters. The focal length of output lens 81 can be 3.0 millimeters; for input lens 80, the focal length can be 5.0 millimeters. Both lenses can be treated with an antireflective coating on both ends for 830 nanometer wavelength light, with the reflectance being one percent or less. The silica window 82 can be any convenient width, such as 1.0 millimeter. As noted in FIG. 8, the output end of the input lens 80 and the input end of the output lens 81 both have a convex shape. If "Z" is the axis along the length of the lenses (left to right in FIG. 8), and "R" is the axis perpendicular to "Z" (top to bottom in FIG. 8), then the relationship between Z and R for the input lens can be given by $$Z(R)=2.9615-\sqrt{(8.7706-1.9003R^2)}$$

and the relationship between Z and R for the output lens can be given by $$Z(R)=1.7769-\sqrt{(3.1574-1.9003R^2)}$$

(where "√" signifies a square root).

The invention now being fully described, it will be apparent to one of ordinary skill in the art that many changes and modifications can be made thereto without departing from the spirit or scope of the appended claims.

We claim:

1. In an energy transmission system for initiating ordnance, an apparatus for delivering a high intensity beam to the ordnance or explosive charge, comprising:

a. an energy transmission source;

b. a first means for focusing light having a first end and a second end, wherein the first end is adapted to receive energy from the energy transmission source;

c. a second means for focusing light having a first end and a second end;

d. wherein the second end of the first means for focusing light is located near the first end of the second means for focusing light;

e. wherein the ordnance or explosive charge is located adjacent to the second end of the second means for focusing light; and f. wherein the combined magnification of the first means for focusing light and the second means for focusing light is less than unity.

2. The system of claim 1, wherein the combined magnification of the first means for focusing light and the second means for focusing light is about 0.55.

3. The system of claim 1, further including a gap between the first means for focusing light and the second means for focusing light.

4. The system of claim 1, wherein the first means for focusing light and the second means for focusing light are in contact with each other.

5. The system of claim 1, wherein each of the means for focusing light have a pitch of about 0.25.

6. The system of claim 1, wherein a glass hermetic seal is placed between the first means for focusing light and the second means for focusing light.

7. In an energy transmission system for initiating ordnance, an apparatus for performing built-in testing of the energy transmission system, comprising:

a. a first optic fiber;

b. a second optic fiber;

c. a first means for focusing light having a first end and a second end;

d. a second means for focusing light having a first end and a second end;

e. wherein the first optic fiber and the second optic fibers are mounted in parallel along their axial direction and wherein the ends of the optic fibers are located near the first end of the first means for focusing light; and f. wherein the second end of the first means for focusing light is located near the first end of the second means for focusing light.

8. The system of claim 7, wherein the combined magnification of the first means for focusing light and the second means for focusing light is less than unity.

9. The system of claim 8, wherein the first optic fiber is an energy transmission fiber and the second optic fiber is a built-in test fiber.

10. The system of claim 9, further including a partially reflective dielectric coating on at least one of the second end of the first means for focusing light, and the first end of the second means for focusing light.

11. The system of claim 10, wherein the partially reflective dielectric coating reflects between about one to fifty percent of light back towards the first end of the first means for focusing light.

12. The system of claim 10, wherein the first optic fiber and the second optic fiber each have approximately the same diameter and are each laterally spaced approximately one half of their diameter from the axis of the first means for focusing light.

13. The system of claim 12, wherein the combined magnification of the first means for focusing light and the second means for focusing light is about 0.55.

14. The system of claim 12, further including a gap between the first means for focusing light and the second means for focusing light.

15. The system of claim 12, wherein the first means for focusing light and the second means for focusing light are in contact with each other.

16. The system of claim 12, wherein the ends of the first optic fiber and the second optic fiber are in contact with the first end of the first means for focusing light.

17. The system of claim 12, wherein the ends of the first optic fiber and the second optic fiber are separated by a prescribed gap from the first end of the first means for focusing light.

18. The system of claim 12, wherein a glass hermetic seal is placed between the first means for focusing light and the second means for focusing light.

19. The system of claim 12, wherein each of the means for focusing light have a pitch of about 0.25.

20. In an energy transmission system for initiating ordnance, an apparatus for delivering a high intensity beam to the ordnance or explosive charge, comprising:

a. an energy transmission source;

b. a first gradient index lens having a first end and a second end, wherein the first end is adapted to receive energy from the energy transmission source;

c. a second gradient index lens having a first end and a second end;

d. wherein the second end of the first gradient index lens is located near the first end of the second gradient index lens;

e. wherein the ordnance or explosive charge is located adjacent to the second end of the second gradient index lens; and f. wherein the combined magnification of the first gradient index lens and the second gradient index lens is less than unity.

21. The system of claim 20, wherein the combined magnification of the first gradient index lens and the second gradient index lens is about 0.55.

22. The system of claim 20, further including a gap between the first gradient index lens and the second gradient index lens.

23. The system of claim 20, wherein the first gradient index lens and the second gradient index lens are in contact with each other.

24. The system of claim 20, wherein each of the gradient index lenses have a pitch of about 0.25.

25. The system of claim 20, wherein a glass hermetic seal is placed between the first gradient index lens and the second gradient index lens.

26. In an energy transmission system for initiating ordnance, an apparatus for performing built-in testing of the energy transmission system, comprising:

a. a first optic fiber;

b. a second optic fiber;

c. a first gradient index lens having a first end and a second end;

d. a second gradient index lens having a first end and a second end;

e. wherein the first optic fiber and the second optic fibers are mounted in parallel along their axial direction and wherein the ends of the optic fibers are located near the first end of the first gradient index lens; and f. wherein the second end of the first gradient index lens is located near the first end of the second gradient index lens.

27. The system of claim 26, wherein the combined magnification of the first gradient index lens and the second gradient index lens is less than unity.

28. The system of claim 27, wherein the first optic fiber is an energy transmission fiber and the second optic fiber is a built-in test fiber.

29. The system of claim 28, further including a partially reflective dielectric coating on at least one of the second end of the first gradient index lens, and the first end of the second gradient index lens.

30. The system of claim 29, wherein the partially reflective dielectric coating reflects between about one to fifty percent of light back towards the first end of the first gradient index lens.

31. The system of claim 29, wherein the first optic fiber and the second optic fiber each have approximately the same diameter and are each laterally spaced approximately one half of their diameter from the axis of the first gradient index lens.

32. The system of claim 31, wherein the combined magnification of the first gradient index lens and the second gradient index lens is about 0.55.

33. The system of claim 31, further including a gap between the first gradient index lens and the second gradient index lens.

34. The system of claim 31, wherein the first gradient index lens and the second gradient index lens are in contact with each other.

35. The system of claim 31, wherein the ends of the first optic fiber and the second optic fiber are in contact with the first end of the first gradient index lens.

36. The system of claim 31, wherein the ends of the first optic fiber and the second optic fiber are separated by a prescribed gap from the first end of the first gradient index lens.

37. The system of claim 31, wherein a glass hermetic seal is placed between the first gradient index lens and the second gradient index lens.

38. The system of claim 31, wherein each of the gradient index lenses have a pitch of about 0.25.

39. In an energy transmission system for initiating ordnance, an apparatus for delivering a high intensity beam to the ordnance or explosive charge, comprising:

a. an energy transmission source;

b. a first aspheric silica lens having a first end and a second end, wherein the first end is adapted to receive energy from the energy transmission source;

c. a second aspheric silica lens having a first end and a second end;

d. wherein the second end of the first aspheric silica lens is located near the first end of the second aspheric silica lens;

e. wherein the ordnance or explosive charge is located adjacent to the second end of the second aspheric silica lens; and f. wherein the combined magnification of the first aspheric silica lens and the second aspheric silica lens is less than unity.

40. The system of claim 39, further comprising a silica window located between the first aspheric silica lens and the second aspheric silica lens.

41. The system of claim 40, wherein the combined magnification of the first aspheric silica lens and the second aspheric silica lens is about 0.55.

42. The system of claim 41, further including a gap between the first aspheric silica lens and the second aspheric silica lens.

43. The system of claim 39, wherein a glass hermetic seal is placed between the first aspheric silica lens and the second aspheric silica lens.

44. In an energy transmission system for initiating ordnance, an apparatus for performing built-in testing of the energy transmission system, comprising:

a. a first optic fiber;

b. a second optic fiber;

c. a first aspheric silica lens having a first end and a second end;

d. a second aspheric silica lens having a first end and a second end;

e. wherein the first optic fiber and the second optic fibers are mounted in parallel along their axial direction and wherein the ends of the optic fibers are located near the first end of the first aspheric silica lens; and f. wherein the second end of the first aspheric silica lens is located near the first end of the second aspheric silica lens.

45. The system of claim 44, further comprising a silica window located between the first aspheric silica lens and the second aspheric silica lens.

46. The system of claim 45, wherein the combined magnification of the first aspheric silica lens and the second aspheric silica lens is less than unity.

47. The system of claim 46, wherein the first optic fiber is an energy transmission fiber and the second optic fiber is a built-in test fiber.

48. The system of claim 47, further including a partially reflective dielectric coating on at least one side of the silica window.

49. The system of claim 48, wherein the partially reflective dielectric coating reflects between about one to fifty percent of light back towards the first end of the first aspheric silica lens.

50. The system of claim 48, wherein the first optic fiber and the second optic fiber each have approximately the same diameter and are each laterally spaced approximately one half of their diameter from the axis of the first aspheric silica lens.

51. The system of claim 50, wherein the combined magnification of the first aspheric silica lens and the second aspheric silica lens is about 0.55.

52. The system of claim 50, further including a gap between the first aspheric silica lens and the second aspheric silica lens.

53. The system of claim 50, wherein the ends of the first optic fiber and the second optic fiber are in contact with the first end of the first aspheric silica lens.

54. The system of claim 50, wherein the ends of the first optic fiber and the second optic fiber are separated by a prescribed gap from the first end of the first aspheric silica lens.

55. The system of claim 50, wherein a glass hermetic seal is placed between the first aspheric silica lens and the second aspheric silica lens.

* * * * *